US011020986B2

(12) United States Patent
Saegusa

(10) Patent No.: US 11,020,986 B2
(45) Date of Patent: Jun. 1, 2021

(54) PRINTING APPARATUS

(71) Applicant: TOSHIBA TEC KABUSHIKI KAISHA, Tokyo (JP)

(72) Inventor: Chikahiro Saegusa, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/794,940

(22) Filed: Feb. 19, 2020

(65) Prior Publication Data

US 2020/0398585 A1 Dec. 24, 2020

(30) Foreign Application Priority Data

Jun. 18, 2019 (JP) ..... JP2019-112927

(51) Int. Cl.
*B41J 21/00* (2006.01)
*B41J 2/355* (2006.01)
*B41J 11/00* (2006.01)

(52) U.S. Cl.
CPC ..... *B41J 2/355* (2013.01); *B41J 11/007* (2013.01); *B41J 21/00* (2013.01)

(58) Field of Classification Search
CPC ... B41J 2/355; B41J 11/007; B41J 3/44; B41J 11/008; B41J 3/4075; B41J 2/32
See application file for complete search history.

(56) References Cited

U.S. PATENT DOCUMENTS 6,390,584 B1 5/2002 Larson et al.
8,113,727 B2 * 2/2012 Niwa ..... G09F 3/0294 400/76
2010/0309276 A1 12/2010 Takizawa et al.
2013/0114988 A1 5/2013 Sodeyama
2018/0281471 A1 10/2018 Ito et al.

FOREIGN PATENT DOCUMENTS

EP 0088630 A2 9/1983
JP H08-324062 A 12/1996

OTHER PUBLICATIONS

Extended European Search Report dated Oct. 9, 2020 in corresponding European Patent Application No. 20164210.5, 12 pages.

* cited by examiner

*Primary Examiner* — Huan H Tran
(74) *Attorney, Agent, or Firm* — Kim & Stewart LLP

(57) ABSTRACT

A print apparatus includes a conveyor configured to convey a sheet along a conveyance path in a first direction. The print apparatus also includes a print head on the conveyance path, a main scan direction of the print head crossing the first direction. The print apparatus further includes a print controller configured to control the print head that in a first print mode prints images on the sheet using a first print reference position on a first end of the print head in the main scan direction and a first image direction parallel to the first direction, and in a second print mode prints images on the sheet using a second print reference position on a second end of the print head in the main scan direction and a second image direction parallel and opposite to the first image direction.

20 Claims, 6 Drawing Sheets

(a)

(b)

PRINTING APPARATUS

CROSS-REFERENCE TO RELATED APPLICATIONS

This application is based upon and claims the benefit of priority from Japanese Patent Application No. 2019-112927, filed on Jun. 18, 2019, the entire contents of which are incorporated herein by reference.

FIELD

Embodiments of the present disclosure relate to a printing apparatus.

BACKGROUND

Conventionally, printing apparatuses exist for printing a sheet of paper or a label, such as a tag or the like. For example, in the field of product distribution or the like, a label printed by a printing apparatus is attached to an object conveyed by a conveyor belt.

The label attachment position on an object can vary based on the type of object, arrangement of the conveyor belt, or the like. For example, a label may be attached to one side surface or another of the object. In such cases, the printing apparatus may need to be rotated, reoriented, or the like, so the label can be attached to the object in a particular manner based on the travel direction and orientation of the object while it is being conveyed along the conveying belt past the printing apparatus.

In the above-described system, the required orientation of a label as output from a printing apparatus may not match that of the existing printing apparatus. Specifically, since the image is printed by a printing apparatus is in a predetermined printing direction onto the label, the direction of the printed image may be different from that required when the label is output from the left side to the right side or when the label is output from the right side to the left side, for example. Therefore, in order to make the appearance of labels output from the printing apparatus match the requirements, it will be necessary to change the printing direction according to the arrangement posture (orientation) of the printing apparatus. In order to make the printing position of the image within the label match the output requirements, it can be necessary to change the reference position used for the printing in accordance with the arrangement posture of the printing apparatus.

However, changing a printer apparatus's output in the above manner is relatively complicated, and it is thus difficult to accomplish with a conventional printing apparatus.

DETAILED DESCRIPTION

According to an embodiment, a printer apparatus includes a conveyor configured to convey a sheet along a conveyance path in a first direction. The print apparatus also includes a print head on the conveyance path. A main scan direction of the print head crosses the first direction. The print apparatus further includes a print controller configured to control the print head in a first print mode to print images on the sheet using a first print reference position on a first end of the print head in the main scan direction and a first image direction parallel to the first direction, and in a second print mode to print images on the sheet using a second print reference position on a second end of the print head in the main scan direction and a second image direction parallel and opposite to the first image direction.

An example of a printing apparatus according to an embodiment will now be described with reference to the accompanying drawings. The present disclosure is not limited to the example embodiments described below.

Figure 1A:
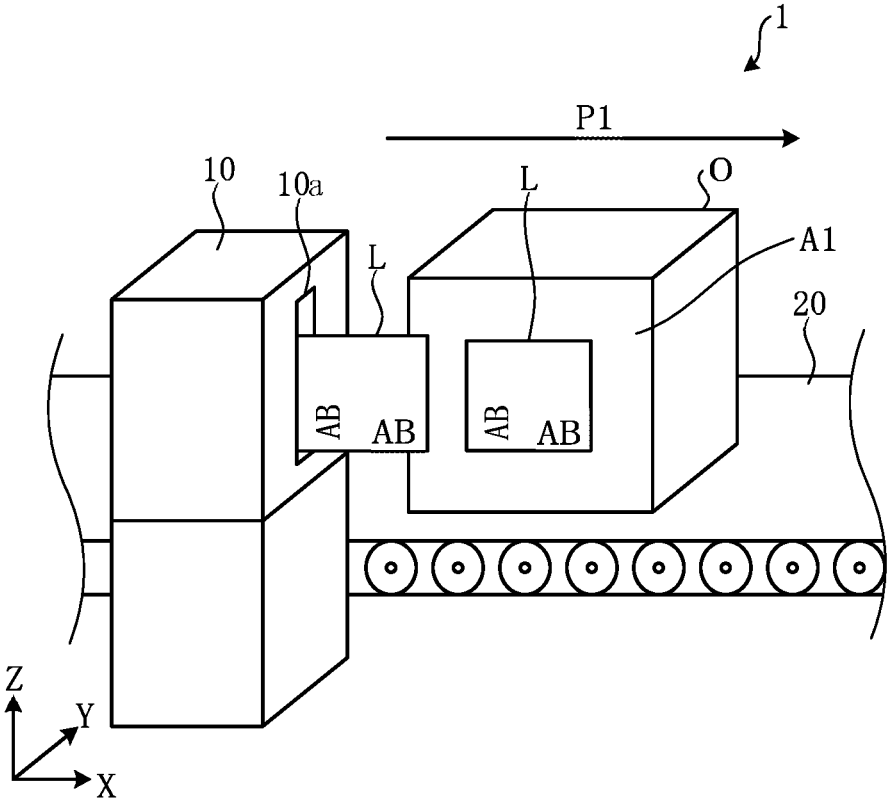
FIGS. 1A and 1B are a diagrams schematically showing an example of a labeler system according to an embodiment.
Figure 1B:
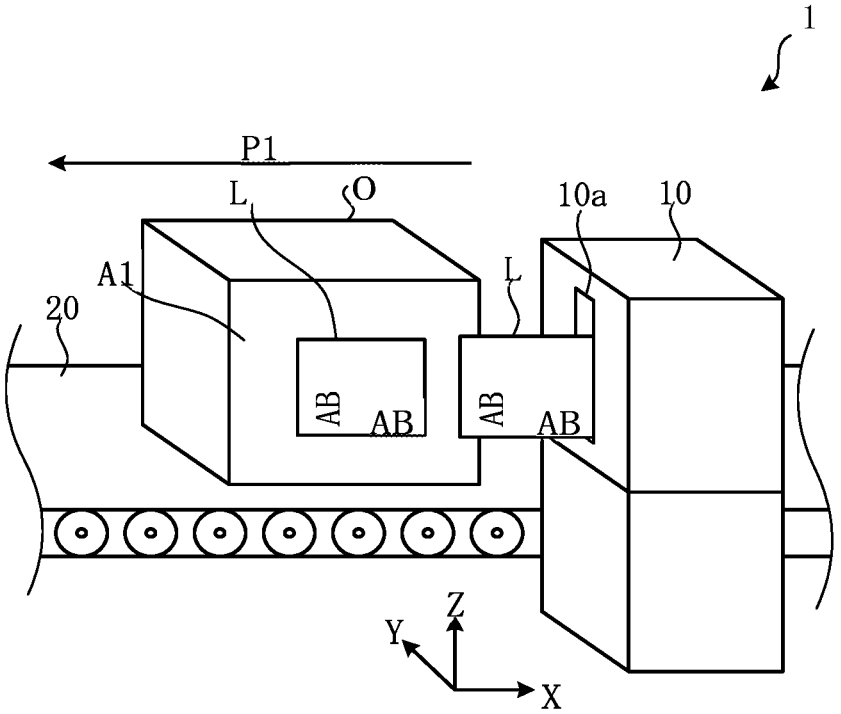

FIGS. 1A and 1B are diagrams schematically showing an example of a labeler system 1 according to an embodiment. As shown in FIGS. 1A and 1B, the labeler system 1 includes a printing apparatus 10 and a conveying device 20 such as a belt conveyor. The conveying device 20 conveys an object O on which a label L printed in printing apparatus 10 is to be adhered to.

The object O is, for example, a box-shaped package or the like. In the labeler system 1, a label L is attached to a side surface of the object O. Hereinafter, the side surface of the object O to which the label L is attached will be referred to as a label-attaching surface A1.

The conveying device 20 conveys the object O in a state in which the label-attaching surface A1 is directed to one side of the conveying device 20, which is orthogonal to the conveying direction P1 of the object O. For example, FIG. 1A illustrates an example of a conveying device 20 that conveys the object O in the right direction (X direction) with the label-adhering surface A1 directed toward the front side (the −Y direction side). FIG. 1B shows an example of the conveying device 20 that conveys the object O to the left in the figure with the adhesive surface A1 directed toward the front side (the −Y direction side).

The printing apparatus 10 is an example of a device that prints labels and the like on objects. The printing apparatus 10 is, for example, a thermal printer, which prints characters or images on one face (surface) of a label L which may correspond to thermal paper, and outputs the characters or images from the discharge port 10*a*. In this embodiment, as will be described later, it is assumed that an adhesive is attached to the other surface (back surface) of label L, such that label L may be adhered to label-attaching surface A1.

The printing apparatus 10 is disposed along the conveying path of the conveying device 20. The printing apparatus 10 is also arranged at a height corresponding to an object O on the side facing the adhesive surface A1 and on the conveying device 20.

In addition, the printing apparatus 10 outputs a label L in parallel or substantially parallel to the label-adhering surface A1 in a state in which the label L is set. Here, "in the vertical state" means that the label L is output at an angle orthogonal or substantially orthogonal to the horizontal direction (X-Y plane). The printing apparatus 10 is arranged such that the back surface of the label L is opposed to the label-adhering surface A1.

For example, in the configuration of FIG. 1A, the printing apparatus 10 is arranged such that the label L is output in the X direction which is the conveyance direction P1 of the object O. In the configuration shown in FIG. 1B, the printing apparatus 10 is arranged so that the label L is output in the −X direction which is the conveyance direction P1 of the object O. Hereinafter, the arrangement of the printing apparatus 10 shown in FIG. 1A is also referred to as a first arrangement posture, and the arrangement of the printing apparatus 10 shown in FIG. 1B is also referred to as a second arrangement posture. The method of realizing the first arrangement posture and the second arrangement posture is not particularly limited. For example, the first arrangement posture and the second arrangement posture can be realized by rotating the label L in the X-axis direction or the Y-axis direction in the normal printing apparatus for outputting the label L in the horizontal direction.

By arranging the printing apparatus 10 in this manner, it is possible to smoothly perform the adherance operation of the label L to the label-adhering surface A1. For example, a label adhering apparatus (not shown) is provided at an output position of label L, and a label L is pushed out in the direction (Y direction) of object O by the label adhering apparatus, thereby efficiently attaching label L to the label-adhering surface A1.

The label adhering apparatus may include, for example, a holding unit which suctions and holds the label L output from the printing apparatus 10 by air pressure (negative pressure), and a driving mechanism which moves the holding unit in the direction of the conveying device 20 (the Y direction and the −Y direction). In the label adhering apparatus, the label L can be attached to the label-adhering surface A1 by moving the holding portion, which holds the label L, in the Y direction in accordance with the speed at which the object O moves along conveying device 20.

The appearance of the label L output from the printing apparatus 10 might not match that depicted for one of the postures/orientations of a printing apparatus 10 depicted in the figures. Specifically, since the label printing is typically performed for a predetermined printing direction for the image printed by the printing apparatus 10 on the label, the direction of the printed image will be different between the first arrangement posture (FIG. 1A) and the second arrangement posture (FIG. 1B) if there is no accounting for the changing between postures. Therefore, in order to make the appearance of the label output by the printing apparatus 10 match when postures are different, it may be necessary to change the printing direction of the image to account for differences in the arrangement posture of the printing apparatus 10. In order to make printing position of the image on the label L match for different printing apparatus orientations, it is necessary to change the reference position used in the printing in accordance with orientation/posture of the printing apparatus 10.

Thus, to make the appearance of label L output from printing apparatus 10 in the first arrangement posture and the second arrangement posture match to each other, it is necessary to change various settings relating to printing in the printing apparatus 10.

Therefore, the printing apparatus 10 according to the present embodiment is capable of changing the printing settings according to whether the printing apparatus 10 is in the first arrangement posture or the second arrangement posture.

Figure 2:
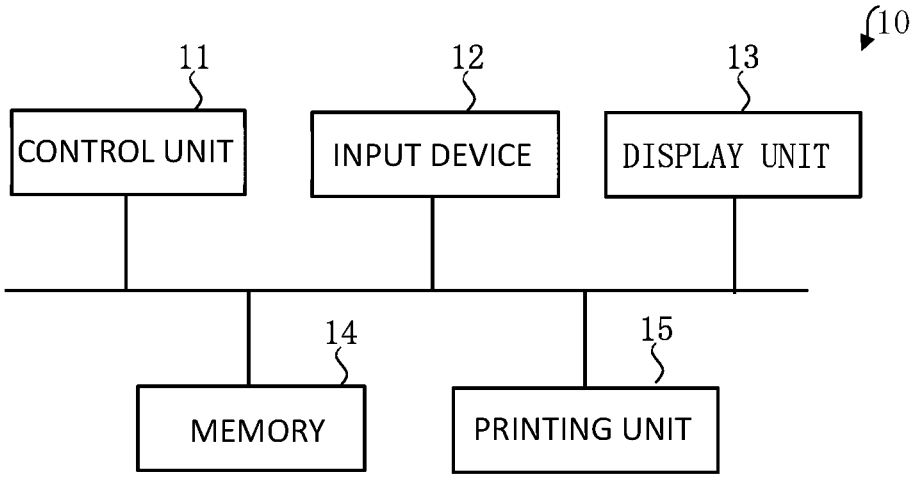
FIG. 2 depicts aspects of a printing apparatus according to an embodiment.

FIG. 2 is a diagram showing an example of a hardware configuration of a printing apparatus 10. As shown in FIG. 2, the printing apparatus 10 includes a control unit 11. The control unit 11 can be a computer including components such as a processor, such as a CPU (Central Processing Unit), a ROM (Read Only Memory), a RAM (Random Access memory), a RAM (Random Access Memory), and the like.

The input device 12, the display device 13, the memory 14, and the like are connected to the control unit 11 via a bus, an input/output controller, and the like.

The input device 12 is used for operating the printing apparatus 10. The input device 12 includes, for example, a button for switching a printing mode of the printing apparatus 10. The display device 13 is a liquid crystal display or the like. The display device 13 can be used to display various kinds of information as directed or controlled by the control unit 11.

The memory 14 can be a nonvolatile storage device such as a hard disk drive (HDD) or a flash memory. The memory 14 stores various programs that can be executed by the control unit 11 (or a processor) and various pieces of setting information (e.g., printing parameters). The memory 14 also stores image data for printing. The image data may include characters, text, images or the like to be printed on label L.

Figure 3:
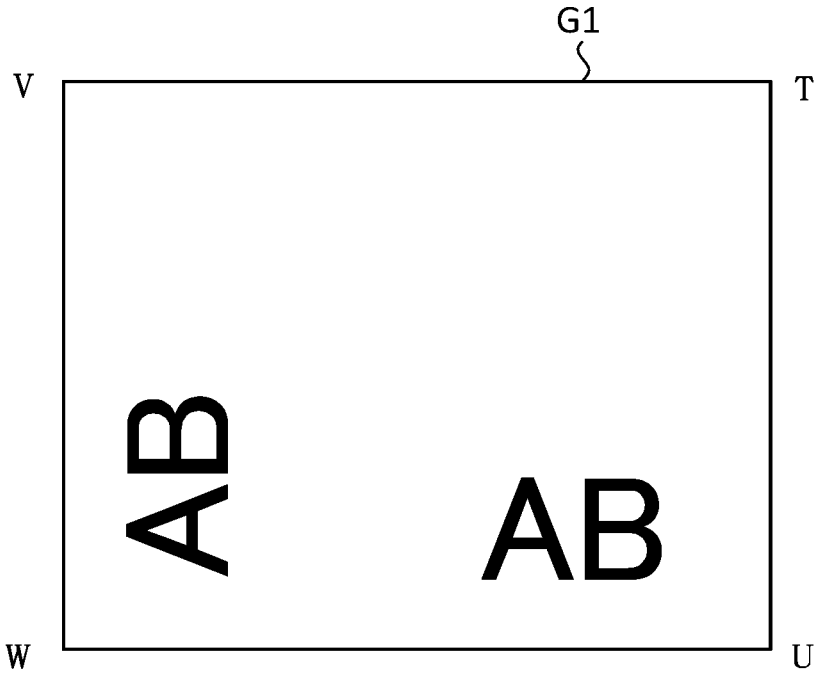
FIG. 3 is a diagram schematically illustrating an example of image data.

FIG. 3 is a diagram schematically showing an example of image data. In FIG. 3, image data G1 has an image size corresponding to the size of label L, for example, and holds an image such as a character string to be printed. In addition, the sheet direction for specifying the printing start direction is set in the image data. For example, in image data G1, it is assumed here that the right end side (T-U side) is a front end side (leading edge) and the left end side (V-W side) is a rear end side (trailing edge).

In this example embodiment, the image data G1 is data stored in the memory 14 in advance, but the present disclosure is not limited thereto. For example, image data G1 may be dynamically generated data in other examples. In such a case, image data G1 may include different images (e.g., different serial numbers or the like) for each label L.

The printing unit 15 is connected to the control unit 11 via a bus, an input/output controller, or the like. The printing unit 15 has various mechanisms related to printing of a label L. Under the control of the control unit 11, the printing unit 15 performs an operation for printing characters or the like represented by image data on the surface of the label L.

Figure 4:
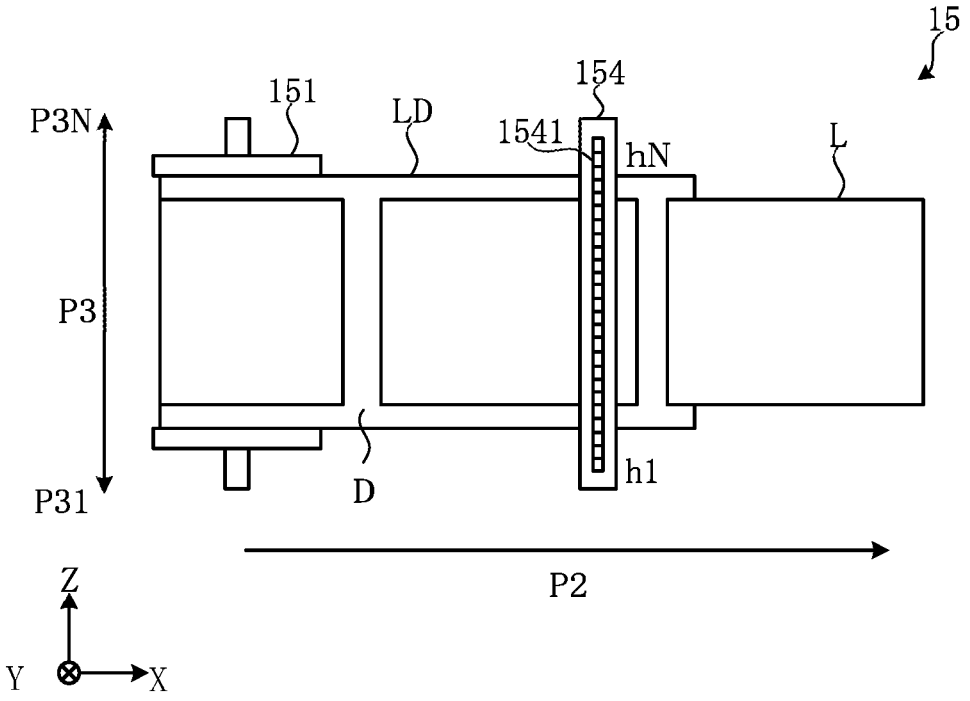
FIG. 4 is a diagram schematically showing an example of a configuration of a printing unit of a printing apparatus according to an embodiment.
Figure 5:
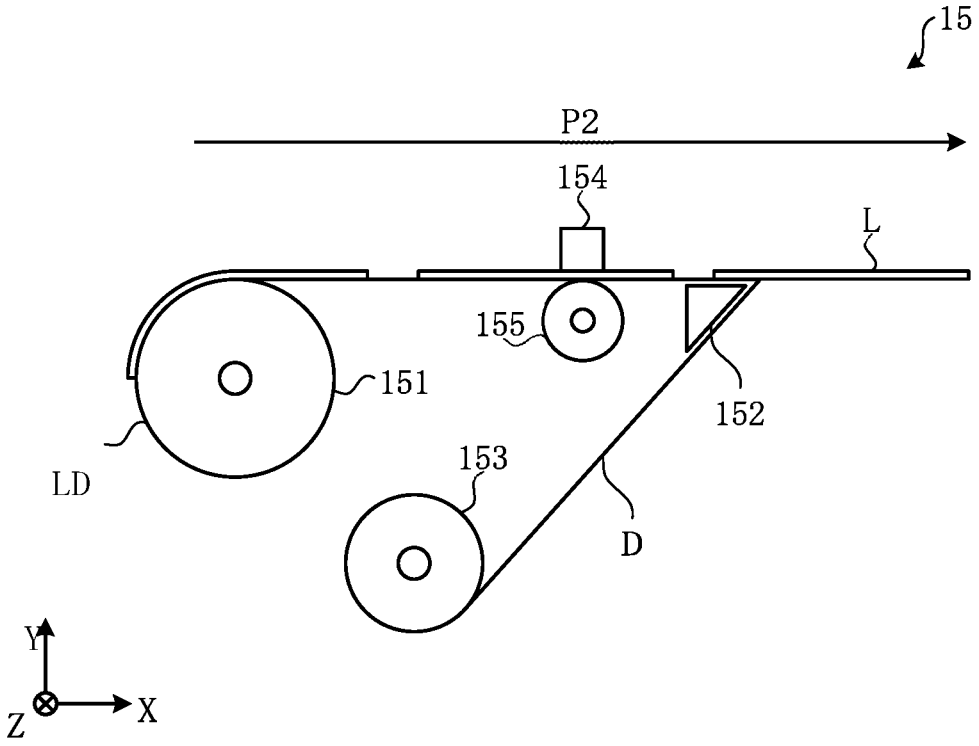
FIG. 5 is a diagram schematically showing an example of a configuration of a printing unit included in the printing apparatus according to the embodiment.

FIGS. 4 and 5 are diagrams schematically showing an example of the configuration of the printing unit 15 included in the printing apparatus 10. Here, FIG. 4 is a view of the printing unit 15 of the printing apparatus 10 as viewed from the Y direction in FIGS. 1A and 1B, and FIG. 5 is a view of the printing unit 15 of the printing apparatus 10 as viewed from the Z direction in FIGS. 1A and 1B.

As shown in FIGS. 4 and 5, the printing unit 15 includes a sheet holder 151, a peeling portion 152, a winding roller 153, a thermal head 154, and a platen roller 155. Here, the sheet holder 151, the piercing portion 152, the winding roller 153, and the platen roller 155 are examples of the conveying portion. Thermal head 154 is an example of a print head.

The sheet holder 151 is a shaft member for rotatably holding a label roll LD (a continuous sheet of labels wound in a roll). The label roll LD is composed of a base sheet D, which is a label releasing paper, and labels L which are on the base sheet D at predetermined intervals. In this example, each label L is a heat-sensitive (thermal) paper that develops color when heated and is attached to the base sheet D with adhesive.

Here, the holding position of label roll LD held by sheet holder 151 can be adjusted along the axial direction of sheet holder 151, that is, in the main scan direction P3 orthogonal to sheet conveying direction P2 by at least some amount. With this configuration, it is possible to change the conveying position of label sheet LD in the main scan direction P3 by the movement of sheet holder 151.

For example, as shown in FIG. 1A, when the label L is a first arrangement posture and the label L is output in the X direction, the label roll LD is held such that the label roll LD is positioned closer to the position P31, which in this first arrangement posture corresponds to the downward (gravity) direction (i.e., towards the ground). The position P31 corresponds to the end position on the "h1" side end of thermal head 154. When, as shown in FIG. 1B, the label L is the second arrangement posture and the label L is output in the −X direction, the label roll LD is held such that the label roll LD is moved toward the position P3N side, which is in this second arrangement posture, now corresponds to the downward (gravity) direction. The position P3N corresponds to another end position (opposite the position P31) of the thermal head 154 on the hN-side end rather than the h1 side end.

In this manner, the label roll LD can be positioned by the sheet holder 151 to be on a downward end according to changes in apparatus posture, thereby suppressing any shifts label L position that might tend to occur in the downward direction during printing operations. Note that the structure of the sheet holder 151 is not particularly limited, and various forms may be adopted. Also, the sheet holder 151 may be configured such that the holding position of the label roll LD automatically moves (drops) in the downward direction when orientation/posture is changed.

The label roll LD supplied from the sheet holder 151 is conveyed along the sheet conveying direction P2 in a vertical state, and reaches the label deattachment portion 152. The label deattachment portion 152 has a tip portion having an acute cross section, and the label roll LD is bent at an acute angle to release the label L from the label roll LD (base sheet D). Label L released from the label roll LD is output to the outside of the printing apparatus 10 from the discharge port 10*a* (see FIGS. 1A and 1B).

The winding roller 153 is driven to rotate by a motor or the like, and the label roll LD (base sheet D) from which label L has been peeled is wound up on the winding roller 153.

The thermal head 154 is provided on the conveying path from the sheet holder 151 to the label deattachment portion 152. The thermal head 154 has N (N is an integer equal to or greater than 2) heating elements 1541 arranged along a main scan direction P3 that is orthogonal to the sheet conveying path P2. In the present embodiment, it is assumed that the first (1h) to Nth (Nh) heating elements 1541 are arranged from the right end side to the left end side of the main scan direction P3 as viewed from the upstream side of the sheet conveying path P2. Hereinafter, the right end side of the main scan direction P3 (thermal head 154) as viewed from the upstream side of the main scan direction P3 is referred to as "h1" side, and the left end side of the main scan direction P3 (thermal head 154) as viewed from the upstream side of the sheet conveying path P2 is referred to as "hN" side.

The platen roller 155 is formed of, for example, a cylindrical rubber member, and is provided at a position opposite to the thermal head 154. The platen roller 155 presses the label roll LD towards the thermal head 154, and drives the label roll LD by means of a motor or the like, thereby conveying the label roll LD along the sheet conveying path P2.

The control unit 11 drives the winding roller 153 and the platen roller 155 to carry the label roll LD along the sheet conveying path P2. The control unit 11 controls the heat generation of the thermal head 154 (individual heating elements 1541) to print an image on the surface of the label L according to the image data. Then, the label L that has been printed is released from the label roll LD by the label deattachment portion 152, and is output from the discharge port 10*a* (see FIGS. 1A and 1B).

Figure 6:
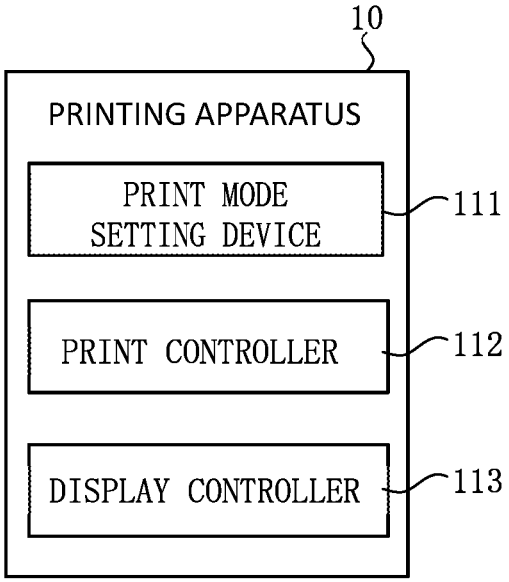
FIG. 6 is a diagram illustrating an example of a functional configuration of a printing apparatus according to an embodiment.

FIG. 6 is a diagram illustrating an example of a functional configuration of the printing apparatus 10.

As shown in FIG. 6, the printing apparatus 10 includes a print mode setting device 111, also referred to as a mode selector 111, a print controller 112, and a display controller 113 as a functional configuration. The functional configuration may be a software configuration realized by cooperation between the processor of the control unit 11 and the program stored in the memory 14. Further, the functional configuration may be a hardware configuration realized by a dedicated processor such as an ASIC (Application Specific Integrated Circuit) included in the control unit 11.

The printing mode setting device 111 is an example of a setting device or a mode selector. The printing mode setting device 111 receives a switching operation instructing a switching between a first printing mode in which one end side along the main scan direction P3 of the thermal head 154 is set as a reference position for printing and a second printing mode in which the other end side along the main scan direction P3 of the thermal head 154 is set as a reference position for printing. When the printing mode setting device 111 accepts a switching of the printing mode, the printing mode setting device 200 stores the currently selected printing mode (after the switching operation) as printer setting information in the memory 14 or the like.

Here, the first printing mode is a printing mode in which "h1" side of thermal head 154 is set as a reference position for printing. The first printing mode is applied to, for example, the first arrangement posture shown in FIG. 1A. On the other hand, the second printing mode is a printing mode in which the "hN" side of the thermal head 154 is set as the reference position for printing. The second printing mode is applied to, for example, the second arrangement posture shown in FIG. 1B.

The method of switching between the first printing mode and the second printing mode is not particularly limited, and various methods can be adopted. For example, the print mode setting device 111 may accept a user switching instruction via the input device 12. In other examples, the print mode setting device 111 may accept a switching instruction via a setting switch such as an internal dip switch.

In other examples, the print mode setting device 111 may detect the position along the main scan direction P3 of the label roll LD as held by the sheet holder 151 by use of a position sensor or the like, and then automatically switch between the first print mode and the second print mode in accordance with the detection result of the position sensor. In such a case, the print mode setting device 111 selects/sets the second print mode when the label roll LD is held at the position P31, and selects/sets the first print mode when the label sheet LD is held at the position P3N.

In other examples, the print mode setting device 111 may directly detect the current arrangement posture of the printing apparatus 10 by using a gyro sensor or the like, and may then automatically switch between the first printing mode and the second printing mode according to the detection result. In such a case, the printing mode setting device 111 selects/sets the second printing mode when the printing apparatus 10 is in the first arrangement posture, and selects/sets the first printing mode when the printing apparatus 10 is in the second arrangement posture.

The print controller 112 controls the printing operations on the label L in conjunction with the printing unit 15. Specifically, the print controller 112 switches the reference position for printing with the thermal head 154 in accordance with the print mode set by the print mode setting device 111. For example, when the first print mode is set, the print controller 112 sets the "h1" side of the thermal head 154 as a reference position. When the second print mode is set, the print controller 112 sets the hN side of the thermal head 154 as the reference position.

The print controller 112 also sets the printing direction of the image represented by the image data G1 in accordance with the print mode as set by the print mode setting device 111. For example, when the first print mode is set, the print controller 112 prints the image represented by the image data G1 from the leading end side to the trailing end side. When the second print mode is set, the print controller 112 prints the image data G1 from the trailing end side to the leading end side.

Figure 7:
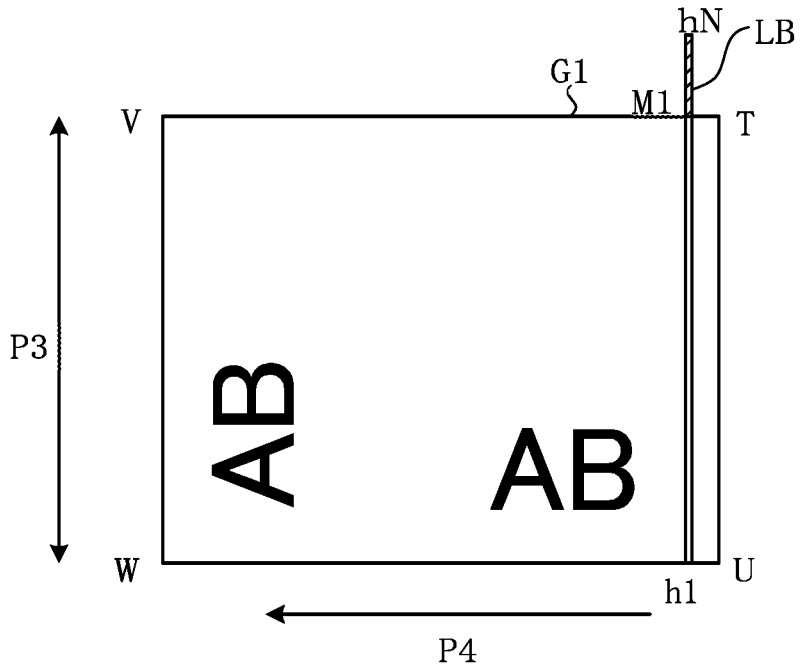
FIG. 7 depicts views related to print control performed by a print controller of an embodiment.
Figure 7:
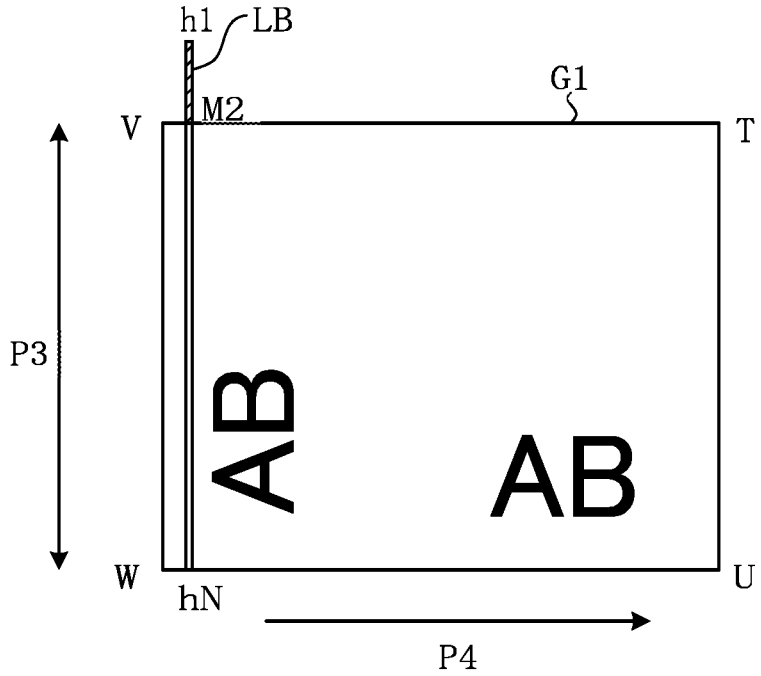

An example of the operation of the print controller 112 will now be described. FIG. 7 includes parts (a) and (b) for explaining print control performed by the print controller 112. In FIG. 7, the line h1-hN signifies a line buffer LB of one row corresponding to the array of the first to Nth heating elements 1541 of the thermal head 154. The end T-U of image data G1 is the leading end side of image data G1, and the end V-W is the trailing end side of image data G1. It is assumed in this example that the numerical value of the line h1-hN corresponds to the first to Nth heating elements 1541.

As described above, when the printing apparatus 10 is in the first arrangement posture (see FIG. 1A), label L (label sheet LD) is aligned toward the "h1" side of the main scan direction P3. In this case, for example, the user sets the first print mode via the print mode setting device 111. According to the setting of the first print mode, the print controller 112 sets the lower end side of the main scan direction P3, i.e., "h1" side, to be the reference position as depicted in part (a) of FIG. 7. The print controller 112 sequentially buffers the image data G1 in the line unit of the main scan direction from the leading end side (T-U side) to the trailing end side (V-W side) of the image data G1 to correspond to the printing direction P4, and prints the image data G1 with the thermal head 154 in the same order as which the print data G1 was buffered. By such control, the image data G1 is printed from the leading end side (T-U side) to the trailing end side (V-W side) as the label L conveyed in the X direction depicted in FIG. 1A with the printing using the first to the M1th heating element 1541. The region of label L corresponding to the M1+1th to Nth heating elements 1541 is a blank space (non-printing region).

On the other hand, when the printing apparatus 10 is in the second arrangement posture (see FIG. 1B), the label L (label sheet LD) is conveyed toward the N side of the main scan direction P3. In this case, for example, the user sets the second print mode through the print mode setting device 111. With the setting of the second print mode, the print controller 112 sets the lower end side of the main scan direction P3, i.e., the hN side, to be the reference position, as depicted in part (b) of FIG. 7. The print controller 112 sequentially buffers the image data G1 from the line unit in the main scan direction to the line buffer LB in the line unit in the main scan direction from the trailing end side (V-W side) to the leading end side (T-U side) of the image data G1 as the printing direction P4, and prints the image data G1 with the thermal head 154. By such control, on a label L conveyed in the −X direction in FIG. 1B, an image represented by image data G1 is printed from the M2th position to the leading end side (T-U side) of the image data G1 by the Nth heating elements 1541. In addition, the region of the label L corresponding to the first to M2th heating elements 1541 corresponds to a blank space.

Thus, the printing apparatus 10 can thus make the appearance of the printed label L match in either of the first arrangement posture or the second arrangement posture. In the printing apparatus 10, since printing can be performed by setting whichever end of the thermal head 154 is the downward end side in the downward (gravity) direction to be the print reference position, the image arranging position (printing position) on the label L can be made to have the same appearance irrespective as to whether the printing apparatus 10 is in the first arrangement posture or in the second arrangement posture.

Referring back to FIG. 6, the display controller 113 performs display control of the display device 13. For example, the display controller 113 displays a GUI (Graphical User Interface) or the like related to the operation of the printing apparatus 10 on the display device 13. Furthermore, the display controller 113 displays information indicating the present state of the printing apparatus 10 on the display device 13. The display controller 113 may also display the currently set print mode on the display device 13.

In this manner, the printing mode is displayed on the display device 13. Accordingly, the user of the printing apparatus 10 can easily confirm in which printing mode the printing apparatus 10 is presently operating by looking at the displayed printing mode on the display device 13, thereby improving convenience.

Figure 8:
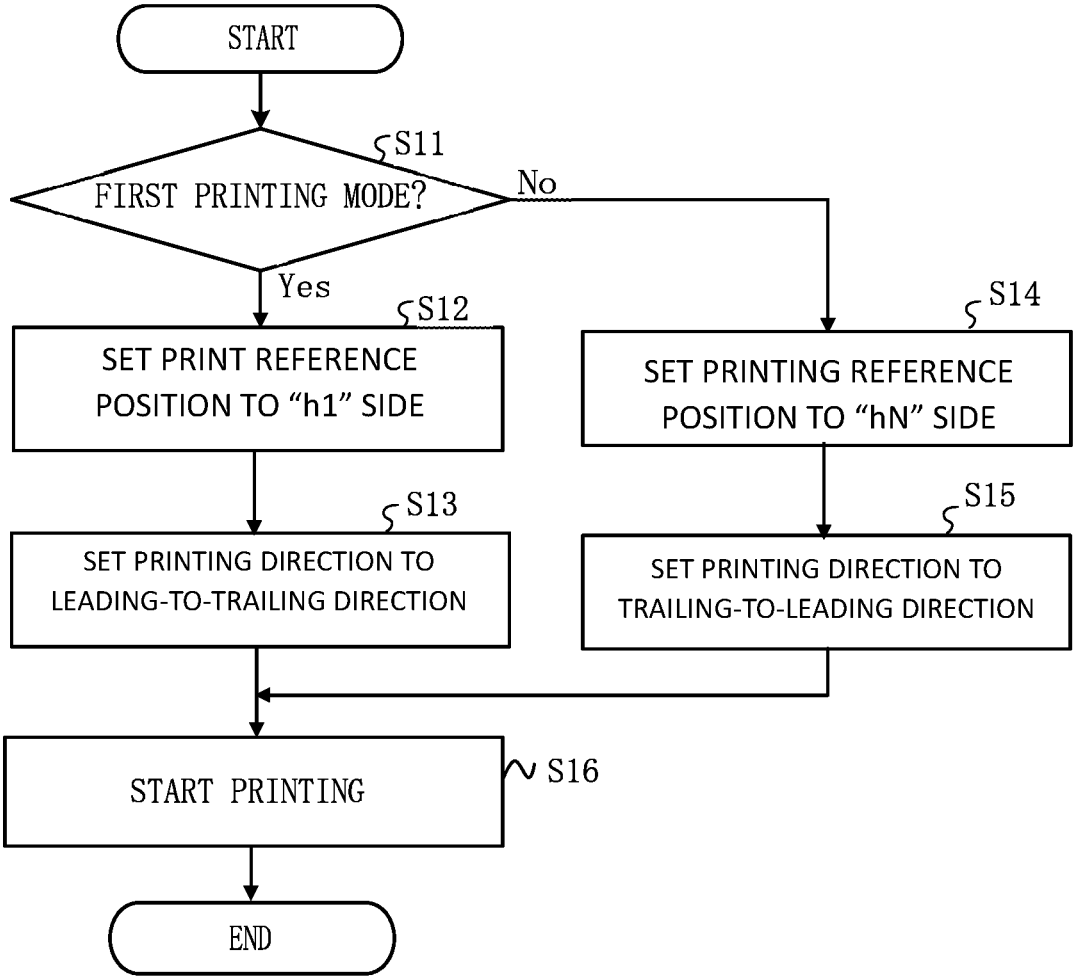
FIG. 8 is a flowchart illustrating an example of print control processing performed by a printing apparatus according to an embodiment.

Next, operation of a printing apparatus 10 will be described with reference to FIG. 8. FIG. 8 is a flowchart showing an example of print control processing performed by printing apparatus 10. It is assumed that one of the first print mode or the second print mode has already been set in advance by the print mode setting device 111.

First, at the time of starting up the printing apparatus or at the time of printing the label L, the print controller 112 determines whether the currently set print mode is the first print mode or the second print mode (step S11).

When it is determined that the first print mode is set (step S11, Yes), the print controller 112 sets the print reference position of the print in the main scan direction P3 to "h1" side of the thermal head 154 (step S12). Then, the print controller 112 sets the printing direction of image data G1 to the direction from the leading end side to the trailing end side (top-to-bottom direction) (step S13), and proceeds to step S16.

On the other hand, when it is determined that the second print mode is set (step S11, No), the print controller 112 sets the reference position of the print in the main scan direction P3 to the "hN" side of the thermal head 154 (step S14). Then, the print controller 112 sets the printing direction of image data G1 to a direction from the trailing end side to the leading end side (bottom-to-top direction) (step S15), and then proceeds to step S16.

Then, the print controller 112 controls the printing unit 15 based on the printing conditions set in the above-described processing then starts printing of label L (step S16), and then subsequently ends the processing after the printing.

As described above, the printing apparatus 10 controls the printing operation by the thermal head 154 by selectively using a first printing mode (in which a first end (e.g., "h1" side) of the thermal head 154 is set as the reference position for printing) or a second printing mode (in which the other end (e.g., "hN" side) of the thermal head 154 is set as the reference position for printing), and performs printing by reversing the printing direction of the image in the first printing mode and the second printing mode. Thus, even when the printing apparatus 10 is physically installed in either of the first arrangement posture or the second arrangement posture, it is possible to make the appearance of label L output from the printing apparatus 10 match for each arrangement posture just by switching between the first printing mode and the second printing mode. Accordingly, with the printing apparatus 10, an appropriate output corresponding to each arrangement posture can be performed.

The above-described example embodiment may be modified by changing a part of the physical configuration or operational functions of the printing apparatus 10. In the following description of various modifications, points of difference from those already described above are mainly described, and a description of similar aspects will not be repeated in detail. Furthermore, the various modifications described below may be carried out individually or in combination with each other as appropriate.

[Modification 1]

In the above embodiment, the printing apparatus 10 outputs the label L in a state where the label L is set, but the output form of the label L is not limited thereto. For example, the label L is output horizontally. In this case, printing apparatus 10 may further comprise a third printing mode in which the reference position for printing is the center of thermal head 154, and a fourth printing mode.

Here, for example, the third print mode is a print mode in which the print reference position is set to the center of the thermal head 154 and the printing direction of the image is set to the end from the leading end. The fourth printing mode is a printing mode in which the reference position of the printing is also set to the center of the thermal head 154 but the printing direction of the image is set to the leading end from the end.

By switching between the third print mode and the fourth print mode, the label L can be attached to the top surface of the object O in the left-right direction of the object O, and the appearance of the label L output from the printing apparatus 10 can be similar no matter the conveyance direction of the object O.

[Modification 2]

In the example embodiment, a sheet serving as a print medium is depicted as label L from a label roll LD is utilized, but the present disclosure is not limited thereto. For example, sheets may be provided as individually separated paper sheets rather than a roll. In the example embodiment, a thermal printing apparatus is used, but the present disclosure is not limited thereto, and printing apparatuses of other types, such as an ink jet system and/or a laser printing system can also be adopted in other examples.

Although a program to be executed by the printing apparatus 10 is generally incorporated into storage medium (memory 14) included in the printing apparatus 10 beforehand, the present disclosure is not limited to this method of distribution of such a program, and such a program may be recorded on a non-transitory, computer-readable recording medium such as a CD-ROM, a flexible disk (FD), a CD-R, a DVD (Digital Versatile Disk), or the like, in an installable form or an executable form, and separately provided. Further, the storage medium is not limited to a computer or a medium independent of an embedded system of the printing apparatus 10, but also includes a storage medium accessible by a local area network (LAN), the Internet, or the like by the printing apparatus 10.

Further, a program executed by the printing apparatus 10 may be stored on a computer connected to a network such as the Internet, and may be downloaded via a network to provide the program. Further, the program executed by the printing apparatus 10 may be provided or distributed via a network such as the Internet.

While certain embodiments have been described, these embodiments have been presented by way of example only, and are not intended to limit the scope of the present disclosure. Indeed, the novel embodiments described herein may be embodied in a variety of other forms; furthermore, various omissions, substitutions and changes in the form of the embodiments described herein may be made without departing from the spirit of the present disclosure. The accompanying claims and their equivalents are intended to cover such forms or modifications as would fall within the scope and spirit of the present disclosure.

What is claimed:

1. A printing apparatus, comprising:

a conveyor configured to convey a sheet along a conveyance path in a first direction;

a print head on the conveyance path, a main scan direction of the print head crossing the first direction; and a print controller configured to control the print head:

in a first print mode to print images on the sheet using a first print reference position on a first end of the print head in the main scan direction and a first image direction parallel to the first direction, and in a second print mode to print images on the sheet using a second print reference position on a second end of the print head in the main scan direction and a second image direction parallel and opposite to the first image direction.

2. The printing apparatus according to claim 1, further comprising:

a mode selector configured to set the first printing mode or the second printing mode, wherein the print controller controls the print head according to set printing mode.

3. The printing apparatus according to claim 1, wherein a width of the sheet in the main scan direction is less than a width of the print head in the main scan direction, and the conveyor conveys the sheet with a sheet edge at one of the first end or the second end of the print head.

4. The printing apparatus according to claim 1, the main scan direction is vertical.

5. The printing apparatus according to claim 1, further comprising:

a mode selector configured to sense an orientation of the print head and to set the first printing mode or the second printing mode accordingly.

6. The printing apparatus according to claim 1, further comprising:

a second conveying unit for conveying an object past the print unit.

7. The printing apparatus according to claim 1, wherein the print head comprises a plurality of heating elements.

8. The printing apparatus according to claim 7, wherein the print reference position is set to a position corresponding to a first one of the plurality of heating elements along the main scan direction when the first print mode is selected, and the print reference position is set to a position corresponding to a last one of the plurality of heating elements along the main scan direction when the second print mode is selected.

9. The printing apparatus according to claim 1, further comprising:

a display configured to display information regarding whether the first print mode or the second print mode is selected.

10. A printing system, comprising:

a print apparatus comprising:

a sheet conveyor configured to convey a sheet along a conveyance path in a first direction, a print head on the conveyance path, a main scan direction of the print head crossing the first direction, and a print controller configured to control the print head:

in a first print mode to print images on the sheet using a first print reference position on a first end of the print head in the main scan direction and a first image direction parallel to the first direction, and in a second print mode to print images on the sheet using a second print reference position on a second end of the print head in the main scan direction and a second image direction parallel and opposite to the first image direction; and an object conveyor configured to convey an object past the print apparatus to receive a printed label on a surface thereof from the print apparatus.

11. The printing system according to claim 10, further comprising:

a mode selector configured to set the first printing mode or the second printing mode, wherein the print controller controls the print head according to the set printing mode.

12. The printing system according to claim 10, wherein a width of the sheet in the main scan direction is less than a width of the print head in the main scan direction, and the conveyor conveys the sheet with a sheet edge at one of the first end or the second end of the print head.

13. The printing system according to claim 10, the main scan direction is vertical.

14. The printing system according to claim 10, further comprising:

a mode selector configured to sense an orientation of the print head and to set the first printing mode or the second printing mode accordingly.

15. The printing system according to claim 10, wherein the print head comprises a plurality of heating elements.

16. The printing system according to claim 15, wherein the print reference position is set to a position corresponding to a first one of the plurality of heating elements along the main scan direction when the first print mode is selected, and the print reference position is set to a position corresponding to a last one of the plurality of heating elements along the main scan direction when the second print mode is selected.

17. The printing system according to claim 10, further comprising:

a display configured to display information regarding whether the first print mode or the second print mode is selected.

18. A printing method, comprising:

conveying a sheet along a conveyance path in a first direction; and controlling the print head on the conveyance path, in which a main scan direction of the print head crosses the first direction, such that:

in a first print mode, to cause the print head to print images on the sheet using a first print reference position on a first end of the print head in the main scan direction and a first image direction parallel to the first direction, and in a second print mode, to cause the print head to print images on the sheet using a second print reference position on a second end of the print head in the main scan direction and a second image direction parallel and opposite to the first image direction.

19. The printing method according to claim 18, further comprising:

sensing an orientation of the print head; and setting the first printing mode or the second printing mode according to the sensed orientation.

20. The printing method according to claim 18, further comprising:

displaying information regarding whether the first print mode or the second print mode is selected.

* * * * *